SKI SERVICING AND REPAIRING TOOL

This is a division of application Ser. No. 663,973, filed Mar. 4, 1976, now U.S. Pat. No. 4,089,076, granted May 16, 1978.

BACKGROUND OF THE INVENTION

The present invention relates to a tool assembly for servicing and repairing skis and, more particularly, to such an assembly which, while being compact and readily portable, is capable of performing all of the operations involved in the maintenance of the running surfaces and edges of skis.

Modern skis typically have plastic faced bottom surfaces with metal strips along the lateral edges thereof. During use, these surfaces and edges become nicked and scratched, impairing the user's speed and control. In order to properly maintain skis so as to obtain good performance therefrom, a number of operations need to be performed, including sharpening of the metal edges by filing both the bottom and lateral edges of the metal strips, planing or scraping of the plastic running surface to remove excess plastic and old or excess wax, and rewaxing by applying a coating of hot wax to the running surface and polishing the coating by use of a block of cork. Numerous devices have been designed to perform one or more of these operations. Typical devices of the prior art are shown in U.S. Pat. Nos. 3,045,639; 3,136,659; 3,831,235 and 3,875,825; Austrian Pat. Nos. 102,121 and 200,485; German Pat. Nos. 463,052; 723,265 and 960,164; and Swiss Pat. Nos. 86,396; 88,916; 179,792 and 425,577. No single device is provided in the prior art, however, which is capable of performing all of the operations involved in maintaining the running surfaces and edges of skis so that it is necessary for the ski enthusiast to purchase several expensive pieces of equipment if he wishes to maintain his skis himself. Also, many of the prior art devices are large and, thus, not readily portable.

The primary object of the invention is the provision of a tool which, by the use of interchangeable elements or subassemblies, may be used to perform all of the operations required to maintain the running surfaces and edges of skis.

Another object of the invention is the provision of a ski repairing and servicing tool which is sufficiently compact as to be readily portable.

Yet another object of the invention is the provision of a ski repairing and servicing tool which is of durable construction and which may be manufactured and sold at a reasonable cost so as to be affordable by individual ski enthusiasts.

BRIEF SUMMARY OF THE INVENTION

The above and other advantages of the invention which will become apparent hereinafter are achieved by the provision of a ski servicing and repair tool which includes a basic unit having a base plate and a handle, the handle being shaped so as to fit comfortably in the palm of the user's hand and the base plate having longitudinal and transverse grooves in its bottom surface, an inclined front end and a plurality of mounting holes for attaching ski servicing components. These components include a reversible planing blade adapted to be mounted on the inclined front end of the base plate, a ski center groove scraping blade fitting into the longitudinal groove of the base plate, a guide and clamp unit attachable to the side of the base plate, a wax dispensing assembly also mountable on the base plate, and a cork pad which covers the base plate and is used to polish the waxed ski. The tool assembly also includes a base and heater unit.

For a more complete understanding of the invention and the objects and advantages thereof, reference should be had to the following detailed description and the accompanying drawings wherein there is shown a preferred embodiment of the invention.

BRIEF DESCRIPTION OF THE DRAWINGS

In the drawings:

FIG. 3 is a bottom plan view of the handle and mounting plate assembly;

FIG. 4 is a longitudinal sectional view taken along the line 4—4 of FIG. 3;

FIG. 5 is a fragmentary, exploded perspective view showing the manner of attachment of a planing blade to the mounting plate;

FIG. 6 is a fragmentary, exploded perspective view showing the manner of attachment of a ski center groove scraping tool to the mounting plate and the relationship between the tool and a ski;

FIGS. 7 and 8 are end elevational views of two embodiments of the groove scraping tool;

FIG. 9 is a perspective view of the base and heater assembly;

FIG. 10 is a longitudinal sectional view taken along the line 10—10 of FIG. 9;

FIG. 11 is a fragmentary bottom plan view of the base and heater assembly, the view being taken along the plain designated 11—11 in FIG. 10 and having portions of the assembly broken away for clarity;

FIG. 12 is a perspective view of the wax dispensing subassembly;

FIG. 13 is a longitudinal sectional view taken along the line 13—13 of FIG. 12;

FIG. 14 is a fragmentary plan view of the metering plate forming a part of the wax dispensing subassembly;

FIG. 15 is a fragmentary perspective view showing a file holding clamp attached to the mounting plate for edge filing of a ski;

FIG. 16 is a fragmentary perspective view similar to that of FIG. 15 showing the clamp in its storage position;

FIG. 17 is a fragmentary perspective view showing the use of the clamp of FIGS. 15 and 16 as an edge wax scraper;

FIG. 18 is a perspective view of a cork pad attachment;

FIG. 19 is a perspective view of a brush plate; and

FIG. 20 is a side elevational view illustrating the use of the brush plate in conjunction with the wax dispensing subassembly.

DETAILED DESCRIPTION OF THE PREFERRED EMBODIMENT

Figure 1:
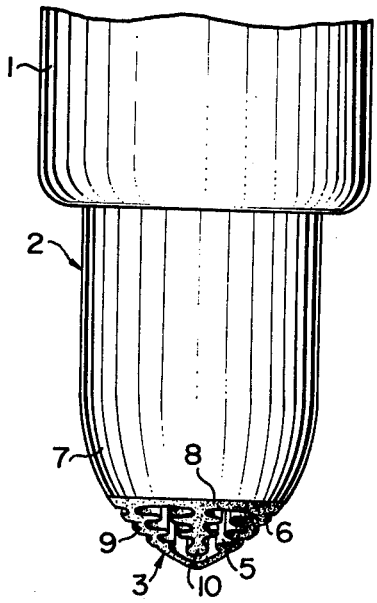
FIG. 1 is a perspective view of the handle and mounting plate assembly of the ski servicing tool.

The handle and mounting plate assembly of the ski servicing device is designated generally by the reference numeral 10 and is illustrated in FIGS. 1, 3 and 4. The assembly 10 includes a base plate 14, preferably an aluminum plate, and a hand grip 16 which may be a

SYNTHETIC RESIN ROD WITH A MULTIPLICITY OF CAPILLARY PASSAGES

FIELD OF THE INVENTION

The invention relates to a rod molded from a synthetic resin material and having a multiplicity of axially extending capillary passages, and more particularly, to a writing nib extruded from a synthetic resin material for use as a writing tip or ink conduit of a writing instrument.

A writing nib is known which is formed by a bundle of longitudinally aligned synthetic fibres which are bonded together with a synthetic resin binder in a manner to define capillary passages between them. The recent trend is to replace such fibre nib by a writing nib which is extruded from a synthetic resin material. The extruded nib can be formed by using a die in which a number of circular nozzles are located at predetermined positions generally in the same manner as the spinning nozzles for synthetic fibres, and by causing molten filaments which are extruded through the nozzles to fuse with adjacent filaments. A desired profile in the nib can be achieved by the use of a die having nozzles of special design therein. The attention is then directed to the design of a cross-sectional configuration of the nib which will produce an improved ink flowability and smoothness of writing.

DESCRIPTION OF THE PRIOR ART

Japanese Laid-Open Utility Model Application No. 51-34833, a counterpart of which is U.S. Pat. No. 4,072,430, discloses an extruded nib comprising a number of independent radial ribs extending radially from the inner wall of an outer cylindrical shell toward the axis thereof, each radial rib being formed of a succession of portions which are alternately of a greater and a lesser circle in transverse cross section. An ink passage is defined between adjacent radial ribs. However, the radial ribs have free ends without interconnection, so that when the end of the nib is shaped into a conical or cup-shaped configuration in order to permit its use as the writing nib of a marker or signature pen, the writing pressure applied to the end may cause a crack therein to degrade the smoothness of writing.

Japanese Laid-Open Utility Model Application No. 91035/1976, a counterpart of which is U.S. Pat. No. 4,065,215, discloses a nib which includes a plurality of radial grooves extending through the axis of the nib and a plurality of arcuate, concentric grooves communicating with the radial grooves. The presence of grooves on the axis causes the writing pressure to spread these grooves, which result in scratching the sheet of paper by the writing tip.

Japanese Laid-Open Patent Application No. 134226/1976, counterparts of which are German Laid-Open Patent Application No. 26 21 544 and U.S. Pat. No. 4,076,428 discloses a number of extruded nibs which have various cross-sectional shapes. The common concept in this instance is the provision of a plurality of trunks radially extending from the inner wall of an outer cylindrical shell and a plurality of branches extending from each trunk, with the branches of each trunk being interleaved or interdigitated with those of adjacent trunks. Each trunk may be independent and terminate in its free end. Alternatively, every other trunk may be joined with each other on the axis of the shell while the remaining trunk may terminate in their free end. While this arrangement appears to be excellent in many respects, it is found that it suffers from the serious disadvantage that a deformation of the writing tip caused by the writing pressure results in entangling the branches having a complex configuration to constrain the movement of those trunks which have the free end, thus preventing these trunks from affording an assistance to the ink flow through their slight movement.

SUMMARY OF THE INVENTION

It is an object of the invention to provide a writing nib molded from a synthetic resin material which avoids formation of cracks in the writing tip when subjected to the writing pressure and which prevents the deformation of the writing tip from blocking an ink passage to thereby assure the smoothness of writing.

It is a specific object of the invention to provide a rod molded from a synthetic resin material and having a multipliciy of axially extending capillary passages and which hence may be preferably used in the manufacture of the writing nib of the kind described above.

In accordance with the invention, there is provided a rod extruded from a synthetic resin material which comprises an outer cylindrical shell, at least three stationary ribs equi-angularly spaced apart and extending radially inward from the inner wall of the shell to the center axis thereof and joined together on the axis, the stationary ribs defining within the shell and between them a plurality of axially extending, independent compartments of substantially equal volume, and a movable rib in each compartment and extending radially inward from the inner wall of the shell toward the axis having its free end located within the associated compartment. Each of the stationary and movable ribs have a plurality of wings in the forms of pairs of symmetrical projections extending from the opposite sides of the rib, the plurality of wings on each rib being disposed circumferentially on concentric circles centered on the axis to leave spaces of an equal size between adjacent wings, the free end of each movable rib being formed as a bulging end which has a circular transverse cross section, the bulging ends of the movable ribs being disposed on a common circle centered on the axis.

The rod of the invention may be formed of any known synthetic resin material used in the art, but is preferably formed of polyacetal resin. The rod can be manufactured continuously using a conventional extruder. In a preferred embodiment, the rod after being extruded, is introduced into another extruder having a crosshead to be surrounded by a sleeve of the same resin material.

The sleeved rod can be cut to length in order to form the writing nib of a marker or signature pen, with one end machined to a conical or cup-shaped configuration. It is also to be noted that the rod can be used as an ink conduit between a ball tip and an ink reservoir of a ball point pen.

When a writing nib is formed with the rod of the invention, the writing pressure applied to the writing tip of the nib does not cause cracking or rupturing of the tip. If the tip is subject to elastic deformation in response to the writing pressure, the wings on adjacent ribs cannot engage each other, so that the ink passages defined between them are maintained. The ink flow is facilitated by the movable ribs which freely rock or sway within the associated compartments to permit a supply of an amount of ink corresponding to that lost from the writing tip. The rocking motion of the movable ribs also contributes to discharging any foreign matter which may have entered the ink passages, thus preventing clogging. As a consequence, when writing letters at a fast rate, no thinning or kreaking occurs. The bulging end of each movable rib is effective to react to the writing pressure applied to the writing tip, thus contributing to the smoothness of writing. In this manner, the smoothness of writing can be achieved even with a nib having an outer diameter which is as thin as 0.6 mm.

BRIEF DESCRIPTION OF THE DRAWINGS

Figure 2:
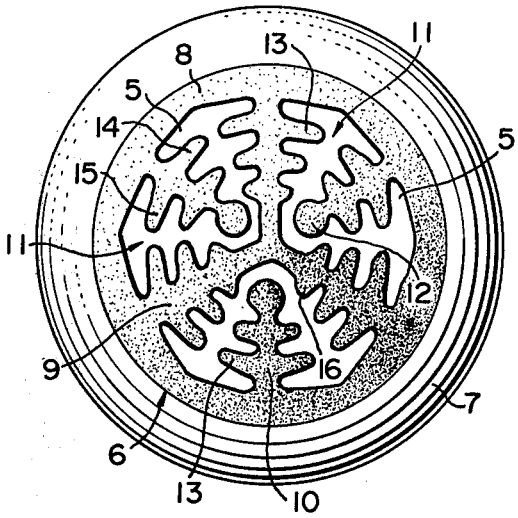
FIG. 2 is an exploded perspective view showing the cooperative relationship of the handle and mounting plate assembly.

FIG. 1 is a fragmentary side elevation of a pen having a writing nib which is formed with the rod of the invention; and FIG. 2 is an end view of the rib shown in FIG. 1, as viewed from the tip end.

DESCRIPTION OF PREFERRED EMBODIMENT

Referring to FIG. 1, a pen body 1 carries a writing nib 2 in its end. While not shown, one end of the nib 2 is disposed in the body 1 and is maintained in contact with an ink reservoir received therein. The other end of the nib 2 is machined to a conical or cup-shaped configuration, providing a writing tip 3.

Referring to FIG. 2, the nib 2 comprises a rod 6 molded from a synthetic resin material and having a multiplicity of axially extending ink passages 5, and a sleeve 7 of a synthetic resin material which integrally surrounds or covers the rod 6. For a writing nib which is used in a typical marker or signature pen, the rod 6 has an outer diameter of 0.6 mm while sleeve 7 has an outer diameter of 0.8 mm. However, its is to be understood that this size is illustrative only, and not limitative of the invention. It should also be understood that the nib 2 is shown in it idealized perfect form, but that in actuality, unintended distortion or irregularity will be produced during the extrusion operation.

The rod 6 comprises an outer cylindrical shell 8, and a plurality of stationary ribs 9 and a plurality of movable ribs 10 which are equi-angularly spaced apart in alternate or interleaved fasion and extending radially inward from the inner wall of the shell 8. In the embodiment shown, there are three stationary ribs 9 and three movable ribs 10. However, more than three ribs each may be provided. The stationary ribs 9 are joined together on the center axis of the shell to define a plurality of independent compartments of substantially equal volume within the shell 8. Each movable rib 10 has a free end terminating in a compartment 11 which is defined by a pair of adjacent stationary ribs 9.

Each of the stationary and movable ribs 9, 10 is provided with a plurality of wings 13, each wing comprising a pair of smoothly contoured projections 14, 15 which extend symmetrically from the opposite sides of the rib. The plurality of wings 13 on the individual ribs 9, 10 are disposed circumferentially on concentric circles which are centered on the axis of the shell, and are circumferentially separated so as leave spaces of approximately equal size between adjacent wings. Consequently, the wings 13 located nearer the center axis of the shell have a reduced length, i.e., smaller circumferential extent, as compared to those located nearer the shell. The free end 12 of each movable rib 10 is formed as a bulging end which has a circular transverse cross section. The bulging ends are disposed on a common circle having its center on the axis of the shell. It will also be noted that a set of auxiliary wings 16 on the stationary ribs 9 are disposed on this common circle, and that the number and thickness of the wings 13 on the ribs 9, 10 are determined in consideration of the diameter of the shell 8.

A plurality of channel-shaped ink passages 5 having a capillary action are defined by the stationary ribs 9 having the wings 13 and auxiliary wings 16 and by the movable ribs 10 having the wings 13 and the bulging free end 12. By experiments conducted with rod 6 having an outer diameter of 0.6 mm and having a cross-sectional configuration as shown in FIG. 2, it has been found that optimum results are obtained when the proportion of the cross-sectional area to the total area of the rod is about 20%. In this instance, the ink consumption per 100 meters of writing length during the initial 500 meters was 0.10 to 0.12 gram for aqueous ink and 0.13 to 0.15 gram for an oily ink when the nib was maintained at an angle of 60° relative to the sheet of paper and run at a rate of 7 cm/sec under a load of 100 grams.

The writing nib can be manufactured as follows:

Rod 6 is initially extruded and then fed into another extruder having a crosshead to have an integral sleeve 7 coated thereon. The rod is then cut to length and its one end machined into a conical or cup-shaped configuration with a rotating grinder. When extruding rod 6 having an outer diameter of 0.6 mm from polyacetal resin, the molding process may take place at a rate of 41 m/min with a charge rate of 11 g/min and under temperature of 185° C.

What is claimed is:

1. A rod extruded from a synthetic resin material comprising: an outer cylindrical shell having a center axis; at least three stationary ribs equi-angularly spaced apart and extending radially inward from the inner wall of the shell to the center axis thereof and joined together on the center axis, the stationary ribs defining within the shell and between them a plurality of axially extending, independent compartments of substantially equal volume; and a movable rib in each compartment and extending radially inward from the inner wall of the shell toward the center axis and having its free end located within the associated compartment; each of the stationary and movable ribs having along its length a plurality of wings each comprised of a pair of symmetrical projections projecting from the opposite sides of the rib, the plurality of wings on each rib being disposed circumferentially on concentric circles centered on the center axis and being circumferentially separated so as to define spaces of approximately equal size between adjacent wings, the free end of each movable rib being formed as a bulging end which has a circular transverse cross section, the bulging ends of the movable ribs being disposed on a common circle centered on the center axis.

2. A rod according to claim 1 in which the outer shell is integrally surrounded by a sleeve of a synthetic resin material.

3. A writing instrument comprising: a pen body; and a writing nib having its one end disposed within the body and its other end projecting out of the body to provide a writing tip, the nib comprising a rod extruded from a synthetic resin material, the tip being formed by machining an end of the rod into a given configuration, said rod comprising an outer cylindrical shell having a center axis, at least three stationary ribs equi-angularly spaced apart and extending radially inward from the inner wall of the shell to the center axis thereof and joined together on the center axis, the stationary ribs defining within the shell and between them a plurality of axially extending, independent compartments of substantially equal volume, and a movable rib in each compartment and extending radially inward from the inner wall of the shell toward the center axis and having its free end located within the associated compartment, each of the stationary and movable ribs having along its length a plurality of wings each comprised of a pair of symmetrical projections projecting from the opposite sides of the rib, the plurality of wings on each rib being disposed circumferentially on concentric circles centered on the center axis and being circumferentially separated so as to define spaces of approximately equal size between adjacent wings, the free end of each movable rib being formed as a bulging end which has a circular transverse cross section, the bulging ends of the movable ribs being disposed on a common circle centered on the center axis.

4. A rod according to claim 1; wherein the symmetrical projections along the length of each rib have progressively smaller circumferential extent in the direction from said shell towards said center axis.

5. A rod according to claim 1; wherein the symmetrical projections along the length of each rib have a smooth contour.

6. A writing instrument according to claim 3; wherein the symmetrical projections along the length of each rib have progressively smaller circumferential extent in the direction from said shell towards said center axis.

7. A writing instrument according to claim 3; wherein the symmetrical projections along the length of each rib have a smooth contour.

* * * * *